United States Patent [19]

Weiss

[11] 4,102,290

[45] Jul. 25, 1978

[54] UNDERWATER BOTTOM CLEANING SYSTEM AND APPARATUS

[76] Inventor: David Weiss, 819 Mitten Rd. #39, Burlingame, Calif. 94010

[21] Appl. No.: 836,606

[22] Filed: Sep. 26, 1977

Related U.S. Application Data

[63] Continuation of Ser. No. 692,841, Jun. 4, 1976, abandoned.

[51] Int. Cl.[2] ..... B63B 59/00

[52] U.S. Cl. ..... 114/222; 15/24

[58] Field of Search ..... 114/222; 15/1.7, 22 R, 15/23, 24

[56] References Cited

U.S. PATENT DOCUMENTS

| | | | |
|---|---|---|---|
| 176,655 | 4/1876 | Martin | 114/222 |
| 328,744 | 10/1885 | Arentz | 114/222 |
| 625,080 | 5/1899 | Zerbe | 114/222 |
| 741,298 | 10/1903 | Binney | 114/222 |
| 2,720,858 | 10/1955 | Siefken | 114/222 |
| 3,303,812 | 2/1967 | Sierra et al. | 114/222 |
| 3,570,256 | 3/1971 | Thompson | 114/222 |
| 3,628,489 | 12/1971 | Michaelsen | 114/222 |
| 3,709,184 | 1/1973 | Laney | 114/222 |
| 3,752,109 | 8/1973 | Seiple | 114/222 |

*Primary Examiner*—Trygve M. Blix
*Assistant Examiner*—Jesus D. Sotelo

[57] ABSTRACT

A bottom cleaning system and apparatus for cleaning submerged portions of hulls includes a cyclically movable brush for operating in cleaning relation to a submerged hull portion while carried submerged in cleaning relation to the hull by an elongate member. Controls for operating the brush are disposed at a position remote from the brush whereby (fluid) connections can extend between the brush and the controls to be operated from the latter. An inflatable diaphragm provides a variably buoyancy which moves the brush between raised and lowered positions into and out of cleaning relation to the hull by controls disposed to be operated at a position remote from the brush. The elongate member can be formed as first and second articulated members whereby the brush can be pivotally operated using articulated movements. In addition, a plurality of such brushes and elongate members can be disposed and arranged on opposite sides of a hull so as to provide complete cleaning of the hull at a number of different locations.

7 Claims, 23 Drawing Figures

FIG_1
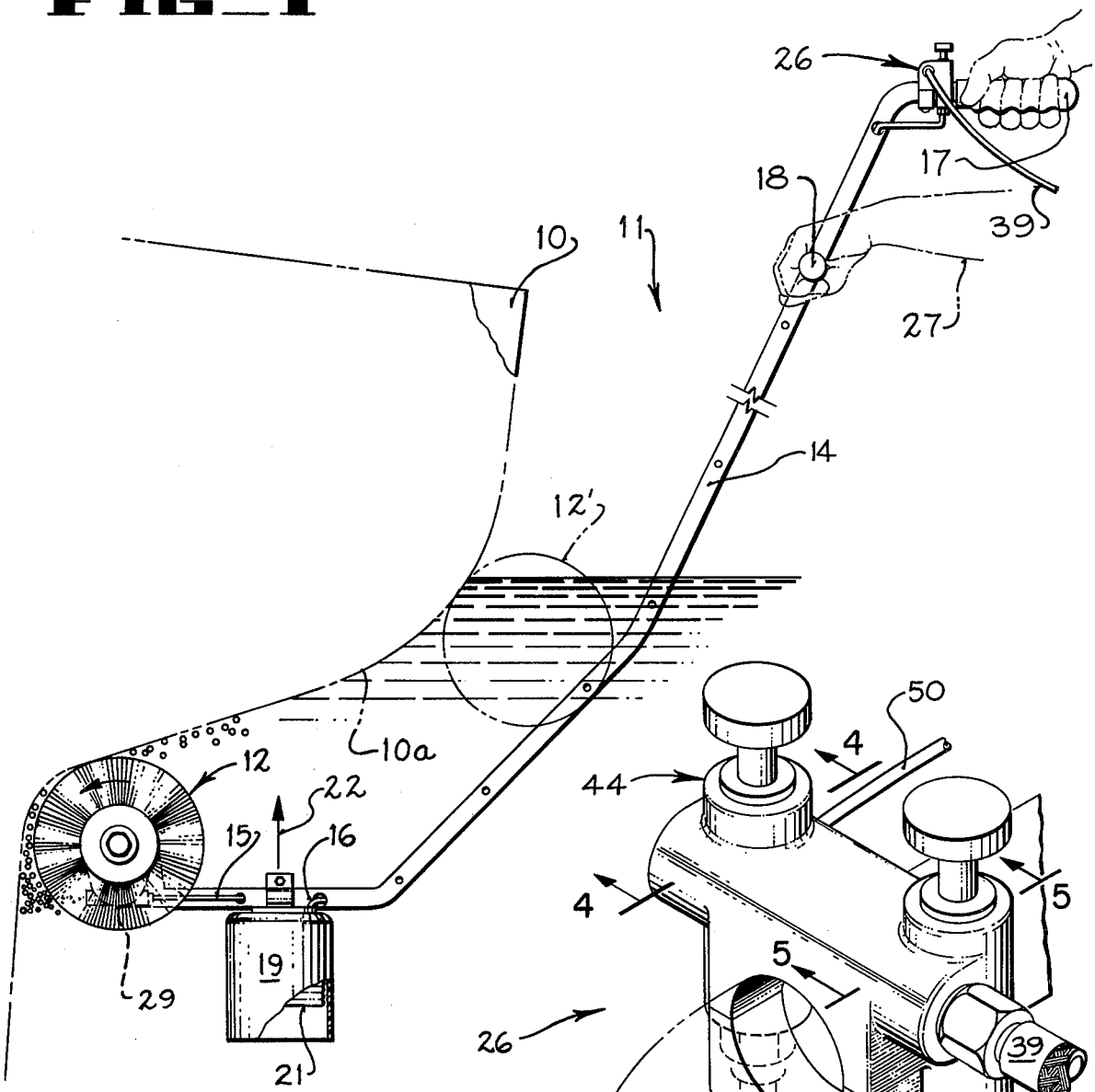
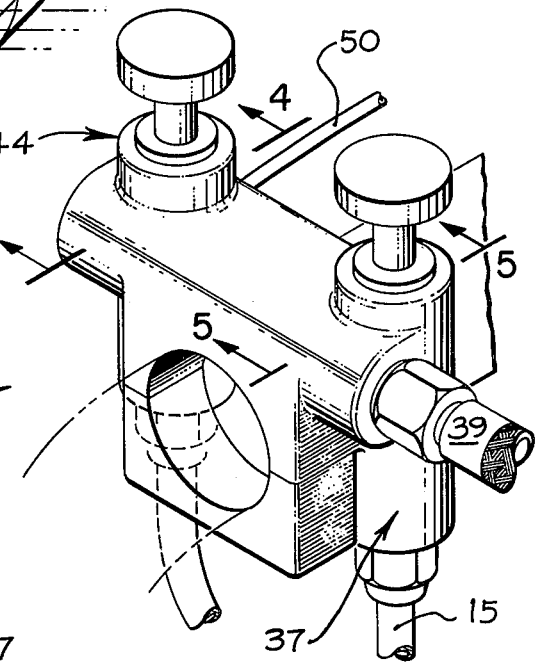
FIG_3
FIG_4
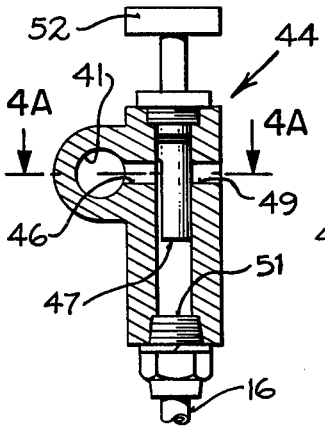
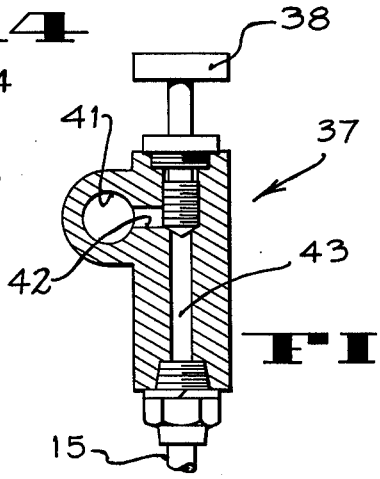
FIG_5

FIG_6
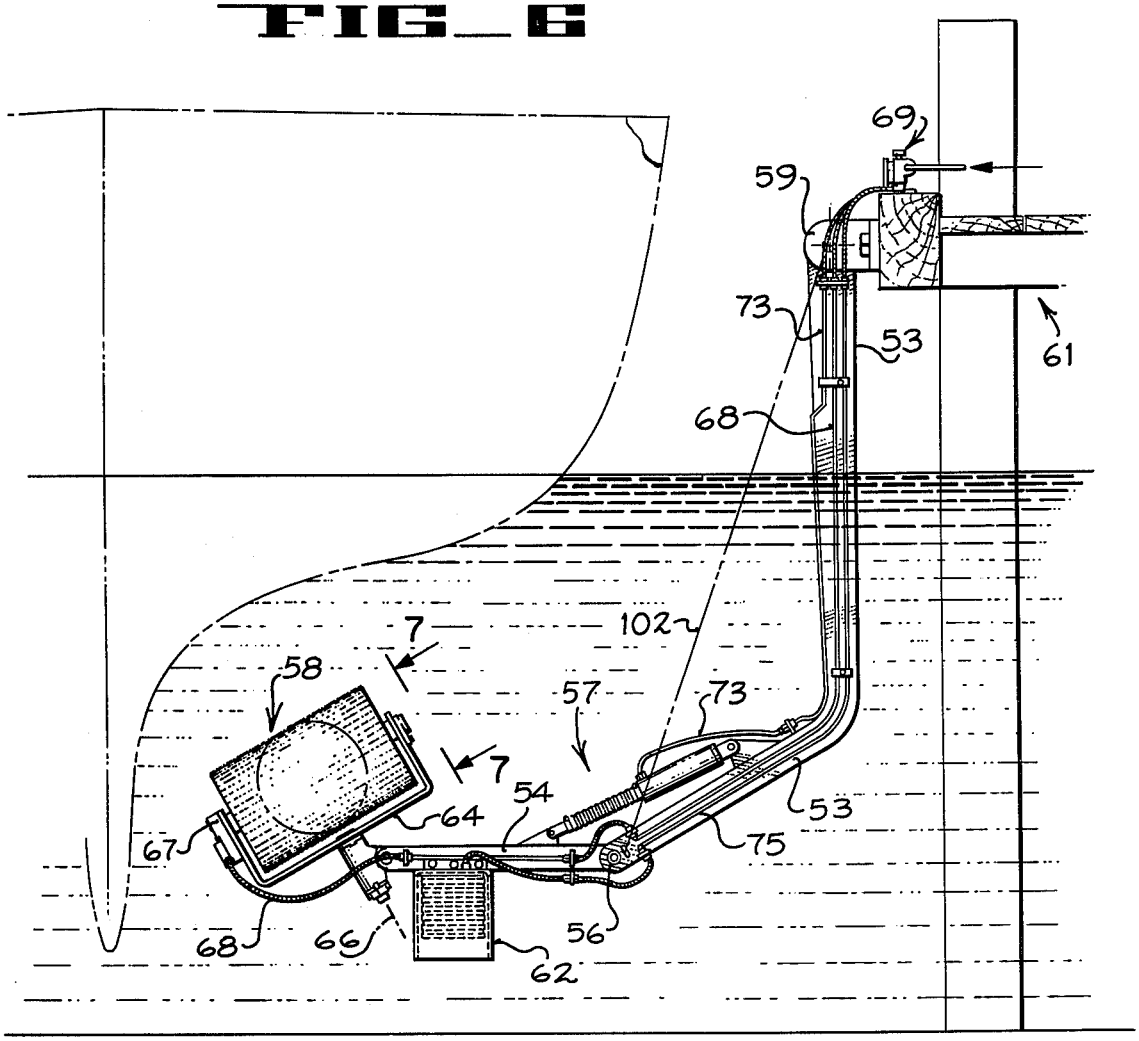
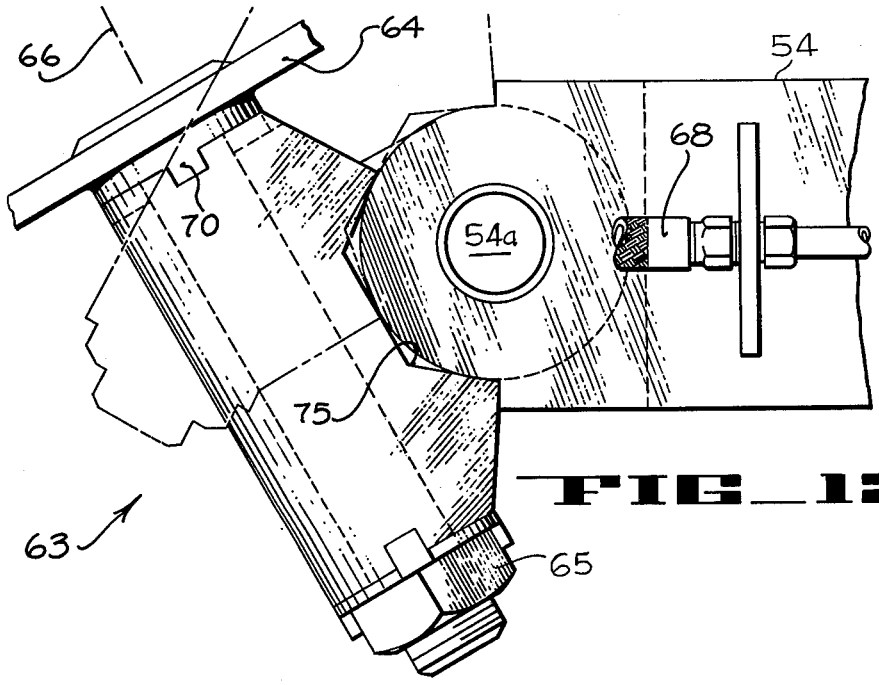
FIG_12

FIG_11
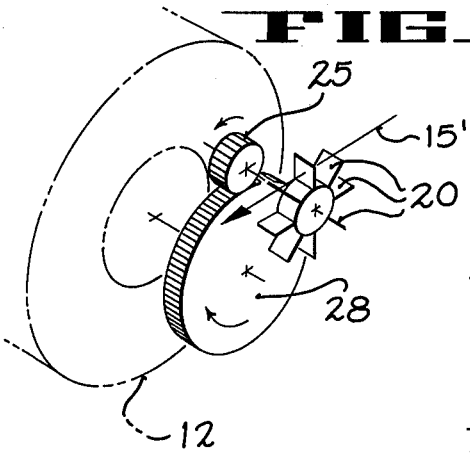
FIG_13A
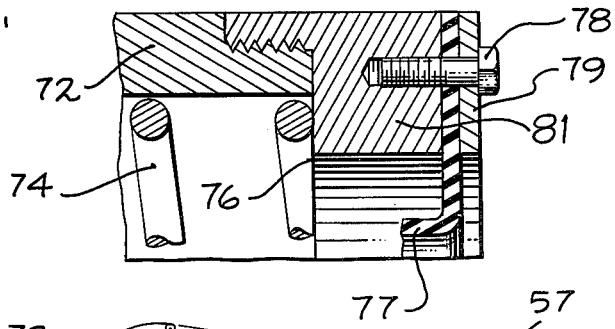
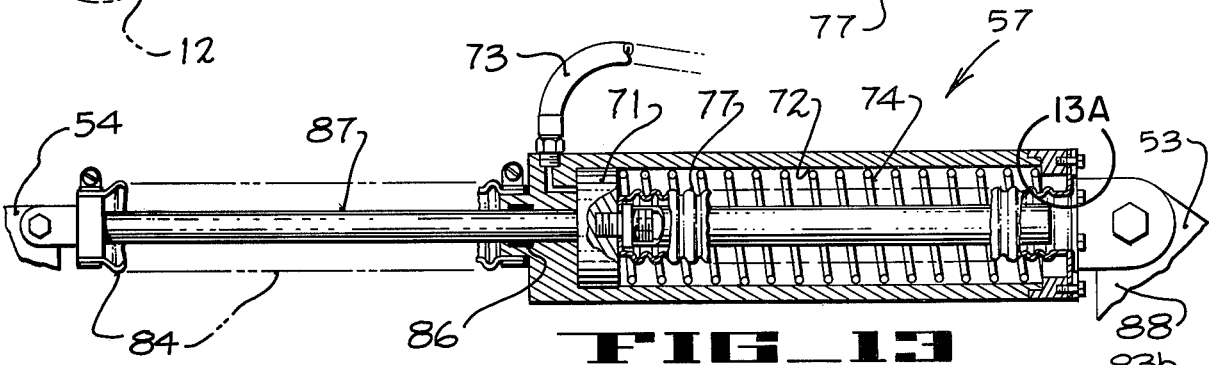
FIG_13
FIG_13B
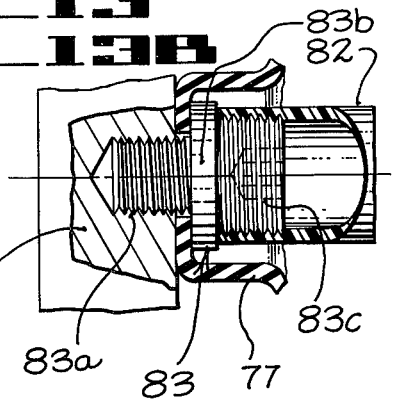
FIG_14
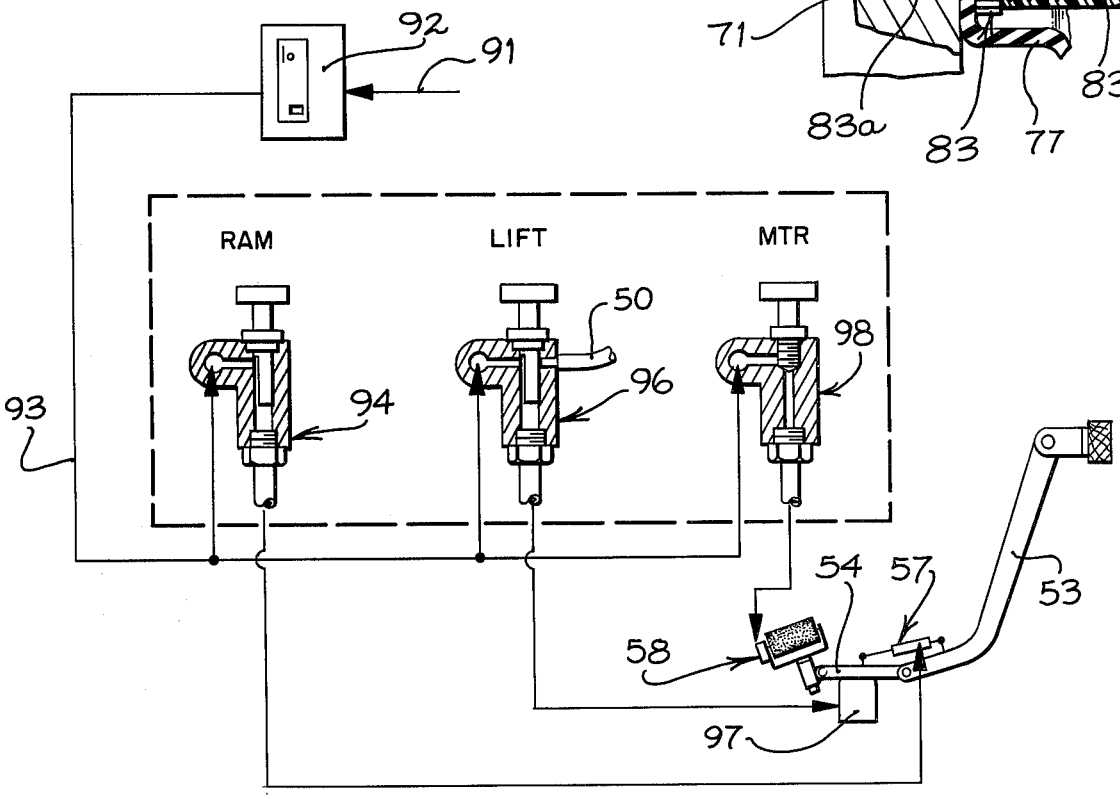

UNDERWATER BOTTOM CLEANING SYSTEM AND APPARATUS

This is a continuation of application Ser. No. 692,841 filed June 4, 1976 now abandoned.

BACKGROUND OF THE INVENTION

This invention pertains to a bottom cleaning system and apparatus for cleaning submerged portions of hulls.

Heretofore, various measures have been necessary in order to clean off the usual collection of growth, dirt, grime and the like which accumulates on the submerged hull portions of boats and ships. Many of these methods for cleaning the underside of a hull are expensive and awkward to operate. In addition to the above it has been observed that such apparatus as heretofore used has not been convenient to operate by the individual and independent boat owner.

SUMMARY OF THE INVENTION AND OBJECTS

In general, cleaning apparatus for cleaning submerged portions of hulls and the like includes cyclically movable cleaning means for operating in cleaning relation to the submerged hull portion. A motor cyclically operates the cleaning means, and both are carried on the submerged end of an elongate positioning member. Controls for operating the motor are disposed at a position remote from the cleaning means whereby the controls can be operated from a position alongside the boat and out of the water. Connections (such as fluid flow connections) extend between the motor and controls to permit such operation. The elongate member carries means having variable buoyancy serving to lift and lower the cleaning means into and out of variable cleaning relation with regard to the hull. Further, valve means operable from a position remote from the cleaning means serves to vary the buoyancy of the buoyant means so as to vary the force applied to lift the cleaning means.

In general, it is an object of the present invention to provide an improved bottom cleaning apparatus and system and particularly one in which a variably controlled buoyant unit is operated from a remote position for applying an upward force to the cleaning unit.

According to another object of the invention, a number of such units are arranged alongside a berth for cleaning the confronting submerged hull as it passes alongside the berth.

A further object is to provide a second and mutually confronting group of units of the kind described whereby a vessel can pass between both groups of units and have the submerged hull portions cleaned on both sides of the vessel.

The foregoing and other objects of the invention will become more readily evident from the following description of preferred embodiments when considered in conjunction with the drawings.

BRIEF DESCRIPTION OF THE DRAWINGS

FIG. 1 shows a diagrammatic elevation view, with portions shown in phantom lines, of a manually operated cleaning apparatus, according to the invention;

FIG. 3 shows a diagrammatic perspective view of a dual valve assembly as used in the system;

FIGS. 4 and 5 show elevation section views taken along the lines 4—4 and 5—5 respectively of FIG. 3;

FIG. 6 shows a diagrammatic elevation view of an articulated cleaning system according to the invention;

FIG. 11 shows a diagrammatic perspective view of a diagram for use in explaining the operation of a fluid drive motor;

FIG. 12 shows an enlarged side elevation view of a supporting knuckle detail for carrying the rotatable brush assembly shown in FIG. 6;

FIG. 13 shows a side elevation section view of a fluid driven actuator for positioning the two pivoted portions of an articulated support arrangement as shown in FIG. 6;

FIG. 13A shows an enlarged detail elevation section taken along the line 13A;

FIG. 13B shows an enlarged detail section view taken in the region 13B;

FIG. 14 shows a diagrammatic view of a valving system for controlling the cleaning apparatus shown in FIG. 6;

DETAILED DESCRIPTION OF PREFERRED EMBODIMENTS

Figure 2:
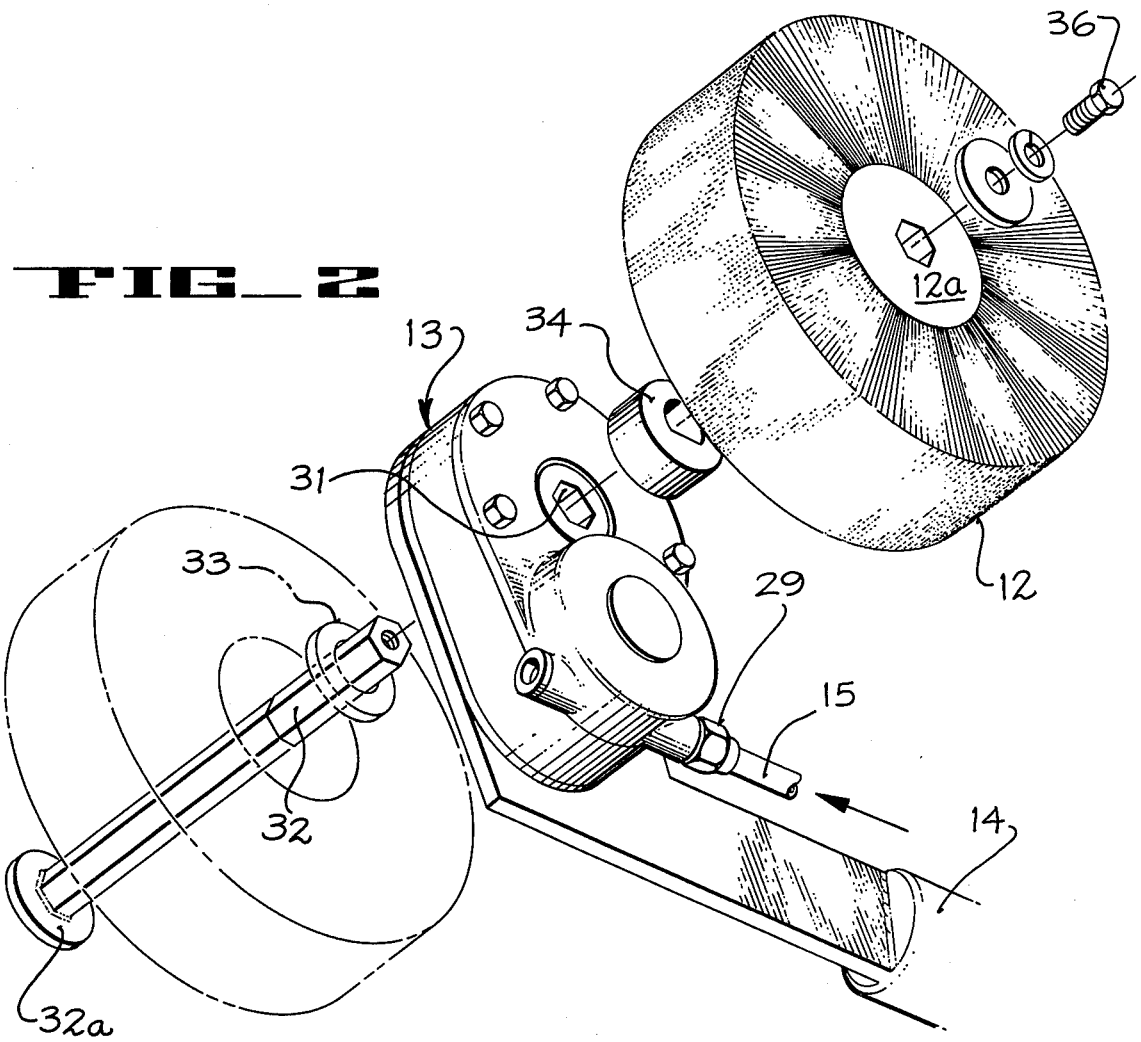
FIG. 2 shows a diagrammatic perspective exploded view of a cyclically rotatable brush unit and motor drive associated therewith.

In its simplest form, a bottom cleaning apparatus 11 for cleaning submerged portions 10*a* of a hull 10 is provided of a type adapted to be manually operated from a stationary platform, floating dock, pontoon or the like with the hull of the vessel to be cleaned brought alongside in close proximity to the hull cleaning apparatus 11. Apparatus 11 includes a cyclically movable cleaning brush assembly 12 and a fluid driven motor 13 of a type, for example, as is driven by air or other gas. Motor 13 and brush assembly 12 are mounted to be carried on the submerged end of an elongate substantially rigid maneuvering or handling member 14. Member 14 is of a generally hollow construction whereby fluid connections in the form of the air lines 15, 16 can be maintained in protective relation within member 14.

A pair of handles 17, 18 disposed on the upper end of member 14 are used much in the manner of handling a scythe. Each of the hands of an operator can hold an associated one of the two handles 17, 18 to more readily maneuver member 14 and brush 12 carried thereby.

Means having variable buoyancy serves to lift and lower the cleaning means of brush assembly 12 into and out of varying cleaning relation with respect to the hull portions 10*a*. Thus a semi-rigid protective jacket 19 carried from the lower region of member 14 contains an inflatable diaphragm 21. Upon inflating diaphragm 21 there will be applied an increasing force acting upwardly in the direction of arrow 22 so as to lift brush 12 into a firmer cleaning relation with respect to hull 10.

Inflation and deflation of diaphragm 21 serve to increase and decrease the buoyancy supporting brush assembly 12.

Figure 15:
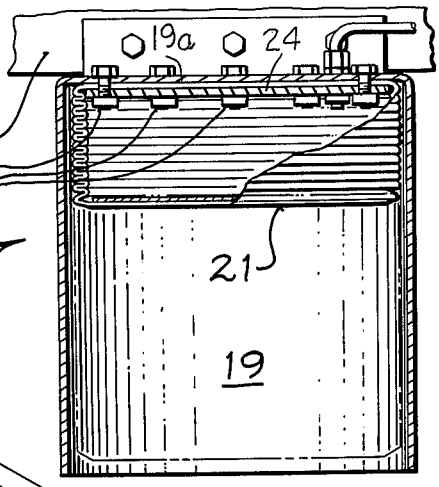
FIG. 15 shows an enlarged detail view partially in section of a buoyancy control device.

As shown in FIG. 15, explained in greater detail below, the top portion of diaphragm 21 is clamped by means of bolts 23 between a pressure plate 24 and the top 19*a* of jacket 19.

Preferably diaphragm 21 is provided in the form of an expansible bellows having accordion pleats around its outer side surfaces.

Controls in the form of the valve assembly 26 are disposed in the region of handle 17 for operating motor 13 to rotate brushes 12. By disposing the controls for operating brush assembly 12 at a position remote from the brush, it is possible for the operator (represented schematically only by the arms 27) to more easily manipulate the entire apparatus from an external standing position. Similarly, the buoyancy of diaphragm 21 is regulated by controls located at the same position remote from the submerged apparatus.

As will be more fully explained further below, air entering flow passage 29 from air line 15 serves to drive motor 13.

The portion which is rotated by operation of motor 13 is a rotatable hollow gear 31 (FIG. 2) disposed to receive and mount a correspondingly hexagonally shaped brush support shaft 32, which carries the two brushes 12. One end of shaft 32 has a flange 32*a* for retaining a brush of the kind now to be described thereon. Similarly, washers and spacers such as represented by washer 33 are provided.

Accordingly, after shaft 32 has been disposed through the hollow hexagonal center of gear 31 a spacer 34 is disposed onto shaft 32. Then shaft 32 passes through the hollow hexagonal central portion 12*a* of brush 12. A bolt 36 and its attendant conventional washers retain brush 12 by threading bolt 36 into the end of shaft 32.

The air passing into flow passage 29 serves to provide, through gear reduction, a suitable rotation of brushes 12.

Means are provided for controlling the degree of air supplied to drive fluid motor 13. Accordingly, as shown best in FIG. 5 a needle valve 37 forms part of the valve assembly 26 whereby rotation of the knob 38 serves to move the threaded needle valve 37 between advanced and retracted positions for opening and closing against the seat on which it rests. In operation, air is supplied from a suitable air compressor or other air source via the air supply line 39 into a manifold 41 and then through a flow passage 42 across the needle valve seat and then downwardly through passageway 43 to be discharged downwardly along line 15 to drive motor 13.

The degree to which needle valve 37 is opened governs the rate of operation of brushes 12.

A second valve control formed within valve assembly 26 serves to supply air into and out of diaphragm 21 so as to lift and lower the submerged end of member 14 and brushes 12 which it carries.

Accordingly, a valve assembly 44, also disposed within the housing to valve assembly 26, includes the manifold 41. A flow passage 46 extends from manifold 41 to a rotatable central valving element 47 shown best in the plan view of FIG. 4A. Briefly, valving element 47 is a tightly fitting cylindrical rod-like element formed with a portion thereof removed to provide a flat surface 48.

The valve body portion for valve assembly 44 includes a flow passage 49 and a downwardly directed flow passage 51 connected to the elongate tubing or hose 16.

Figure 4A:
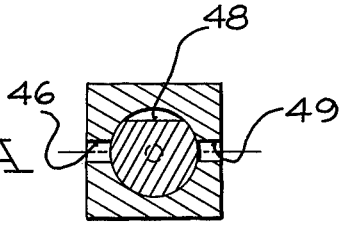
FIGS. 4A, 4B, 4C show a sequence of three positions for the valve element in the valve of FIG. 4 taken along the line 4A—4A of FIG. 4 for purposes of explanation.
Figure 4B:
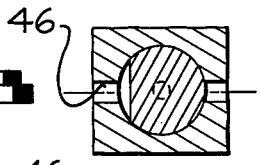
Figure 4C:
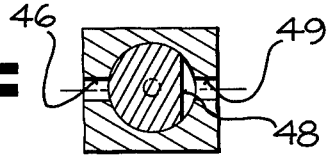

Rotation of knob 52 operates valve 44 to the several conditions represented in FIGS. 4A–4C. Briefly, it is the function of valve 44 to open the air supplied into manifold 41 for purposes of inflating diaphragm 21 and thereby increase the buoyancy thereof. Valve assembly 44 further permits the diaphragm to be deflated by first closing off the pressure supplied by manifold 41 and then opening an exhaust passage 49 from flow passage 51.

Valve assembly 41 further functions to block both the exhaust and supply of air after the diaphragm has been inflated to a proper level as desired.

Accordingly, as shown in FIG. 4A both manifold 41 and exhaust passage 49 are clearly blocked from passing air through valve 44 when element 47 is rotated to the position shown in FIG. 4A with the flat portion 48 as noted.

As shown in FIG. 4B air is supplied under pressure via flow passage 46 to pass downwardly along the relieved flat portion 48 of element 47 so as to permit the air, under pressure, to discharge into diaphragm 21 via lead 16.

As shown in FIG. 4C the pressure created in diaphragm 21 can readily be relieved by rotating valve element 47 to the position whereby the relieved flat portion 48 permits air to escape upwardly and out of exhaust passage 49 (and bleed line 50) while the remainder of valve element 47 serves to block air supply passage 46.

Figures 7, 8, 8A, 9, 10:
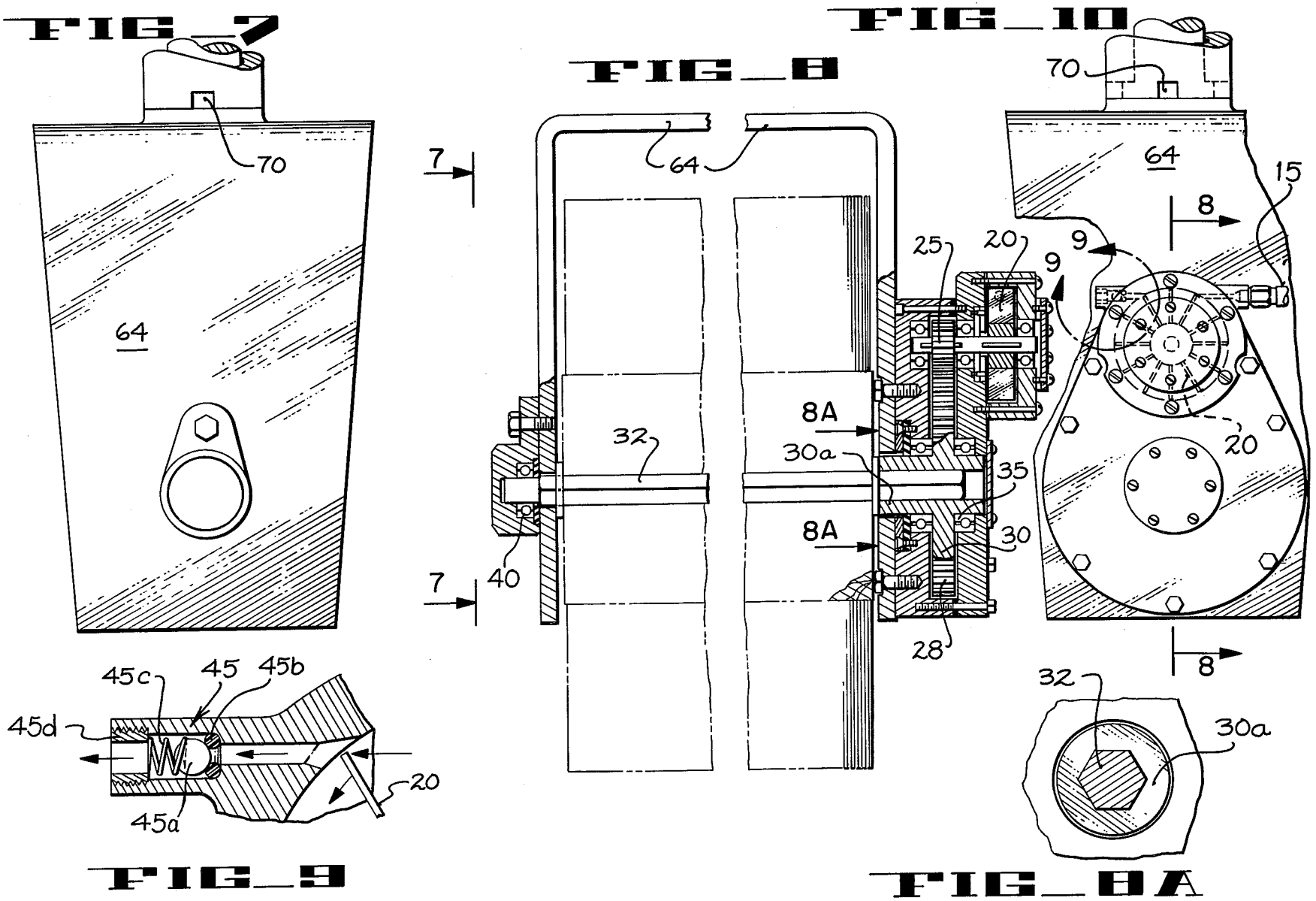
FIG. 7 shows a side elevation view of a brush assembly as shown along line 7—7 of FIG. 8.
FIG. 8 shows a diagrammatic elevation section view taken along the line 8—8 of FIG. 10 showing a rotatable brush assembly and motor drive arrangement.
FIG. 8A shows an enlarged elevation detail view taken along the line 8A—8A of FIG. 8.
FIG. 9 shows an enlarged detail section view taken along the line 9—9 of FIG. 10.
FIG. 10 shows a side elevation with a portion removed of a rotatable cleaning brush and fluid drive motor assembly.

Motor 13 schematically represented in FIG. 2 has been shown in substantial detail in FIGS. 8 through 10 and it is diagrammatically illustrated in FIG. 11.

As shown in FIG. 11, air supplied via air line 15 represented by the arrow 15' serves to strike vanes 20 mounted to rotate about an axis including the gear 25 exposed in mesh with gear 28. Gear 28, in turn, engages the teeth of another gear 30 formed with a central bushing portion 30*a* for receiving the end of the hexagonally shaped brush support shaft 32. Bushing portion 30*a* is locked in and supported by bearings 35 so as to support shaft 32 for rotation to be driven by engagement of gear 30 with gear 28. The other end of shaft 32 is supported by bearings 40.

A spring-loaded valve, as shown best in FIG. 9, permits the air supplied into motor 13 to be discharged therefrom. Valve 45 comprises a ball 45*a* urged against an O-ring seat 45*b* by means of the spring 45*c*. Ball 45*a* and spring 45*c* are captured within the discharge opening by means of the threaded insert 45*d*. Thus, as air is fed into motor 13 under pressure it is permitted to exhaust via check valve 45 while precluding entry of water when pressure is relieved.

From the foregoing it should be readily evident that there has been provided an improved apparatus for cleaning submerged surfaces such as the underwater hull portions of vessels and the like. By permitting control of the upwardly acting forces supplied against the interface between brushes 12 and the bottom surfaces of hull 10 it is possible to clean a vessel as it passes alongside a dock with relative ease in manipulating the hand-held apparatus and the valves since they are provided conveniently at the upper end of the support member 14.

According to another embodiment as shown in FIG. 6 means for carrying the motor and brush assembly (or other cleaning means such as rotating nozzles or the like) comprises first and second elongate members 53, 54 coupled in articulated relation by the pivoted joint 56.

In addition, means such as the pneumatic ram 57 serve to position and hold the first and second members 53, 54 at a given angle to each other so as to dispose the rotatable cleaning brush 58 as desired.

A pivot member 59 is carried by and pivoted to the upper end of member 53. It is adapted to be secured to stationary means such as the dock 61. Further, means operable from the dock serve to move the cleaning means between raised and lowered positions in response to providing changes in buoyancy of a variable buoyancy device 62 controlled by a portion of a valve assembly 69 acting via an air line 75. Valve assembly 69 preferably is of a type as shown in FIG. 4.

The outer end of member 54 carries a knuckle assembly 63 for supporting the yoke 64 in a position as shown in FIG. 6 or in another position rotated 90° about the positioning axis 66. Note for example in FIG. 16 the two positions noted above are achieved by the two leftmost brush assemblies schematically represented.

Yoke 64 is readily oriented between its two positions by first releasing the nut 65 sufficiently to permit the detents 70 to be moved axially out of engagement with associated notches. At that point yoke 64 and its associated brush assembly 68 can be rotated 90° about the axis 66. Detents 70 then engage a second pair of notches (not shown) disposed to provide the orientation shown in FIG. 12. In addition, the angle of orientation of the axis of rotation of brush assembly 58 is readily adjustable about the pivot axis defined through an adjustable pivot connection 54A whereby after the selected angle has been established the pivot connections 54A can be tightened by means of the nut 75.

Brush assembly 58 includes a yoke 64 for supporting a brush element for rotation therebetween. The left end of brush assembly 58 (as shown in FIG. 6) contains a fluid drive motor 67 adapted to be driven by fluid such as air supplied under pressure via air line 68 which passes upwardly along member 53 to be controlled by means of valve assembly 69 carried conveniently on the dock 61.

Air ram 57 is best shown in FIGS. 13 through 13B and includes a piston 71 contained within an open ended cylinder 72 to be driven between advanced and retracted positions by means of air under pressure supplied via the flow passage 73 into and out of cylinder 72. Piston 71 is urged to a position as shown in FIG. 13 by means of a spring 74 acting against the piston at one end and against an internally formed collar 76 at the other end. While it has been stated that one end of cylinder 72 is open it is not open to seawater or other contaminating elements in view of the fact that a collapsible resilient sleeve 77 is formed in a re-entrant manner with respect to cylinder 72 and is held at its outer end to the outer end of cylinder 72 by means of the screws 78 which retain an annular plate 79 in compressed relation against outer end piece 81 threaded onto the end of cylinder 72. Thus, the outer end of sleeve 71 flares outwardly to be captured between plate 79 and end piece 81 while the inner end is held as shown best in FIG. 13B. Means are provided serving to prevent the re-entrant sleeve from buckling or becoming jammed within cylinder 72 as it is moved between advanced and retracted positions as now to be described.

An elongate cylindrical tubing 82 of rigid material is formed with interior threads on its inserted end so as to be able to be threaded onto external threads carried on an inner-sleeve anchor 83. Anchor 83 comprises a threaded stud portion **83*a* for engaging the threads formed within the head of piston 71**.

Anchor 83 also includes a rigid flange portion **83*b* which serves to compress the inner end of sleeve 77 into a sealed relation to the end of piston 71. Flange portion 83*b* carries the threaded portion 83*c* which serves to be threadedly engaged into the end of tubing 82**.

In order to further protect the working parts of ram assembly 57 a compliant, flexible water-tight covering 84 is disposed about piston rod 87. One end of covering 84 is clamped about a boss 86 protruding from the end of cylinder 72. The other end of covering 84 is clamped about a flange carried on rod 87.

One end of ram assembly 57 is pivotally coupled by means of pivot 88 to member 53 while the other end is pivotally connected to member 54.

In operation it is readily evident that the seal through which piston rod 87 must operate into and out of cylinder 72 is protected by means of sleeve 84. At the same time the interior working surface of cylinder 72 is also protected by means of sleeve 77 since sleeve 77 forms a seal at the outer end of cylinder 72 and at its inner end forms a seal with the face of piston 71 so that only the outer end of rod 87 and the exterior of cylinder 72 are exposed to the water.

As schematically shown in FIG. 14 air pressure on line 91 is arranged to be released by introducing a coin box control 92. Upon insertion of appropriate coins into box 92 air pressure is applied to line 93 and then to manifold 41 of the various valve control units as shown. For example, in the case shown in FIG. 14 valve 94 controls the operation of ram assembly 57 of the type described so as to move the two members 53, 54 between advanced and retracted positions. A second valve assembly 96 serves to lift and lower the brush assembly by increasing and decreasing the buoyancy of a unit 97 as above described, and finally the needle valve unit 98 directly supplies varying amounts of fluid flow to the fluid operated motor carried on the end of brush assembly 58.

Figure 16:
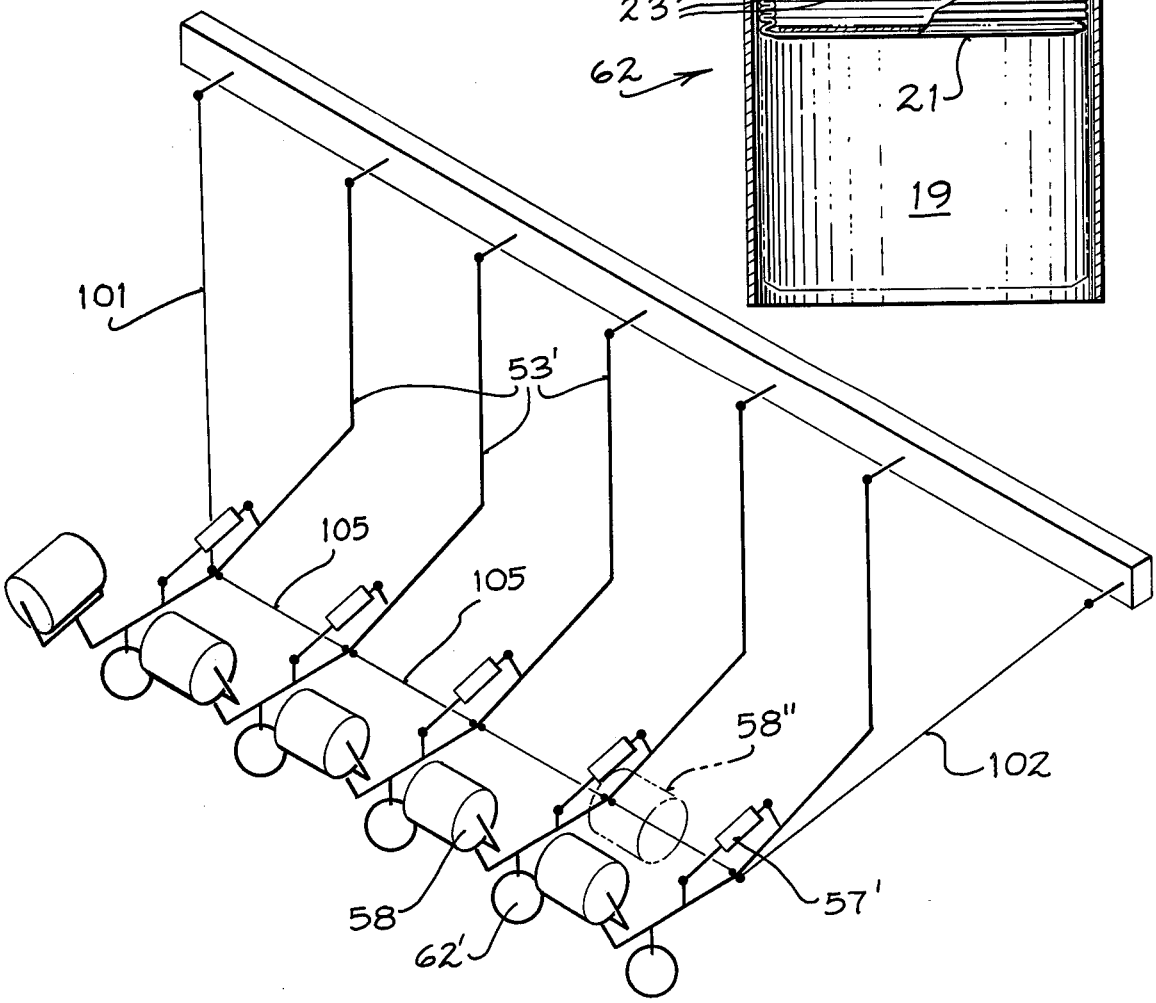
FIG. 16 shows another embodiment of the invention in which a number of independently operable articulated units are secured to a common stationary construction, dock, or the like whereby the entire side of a vessel can be cleaned at a single pass.
Figure 17:
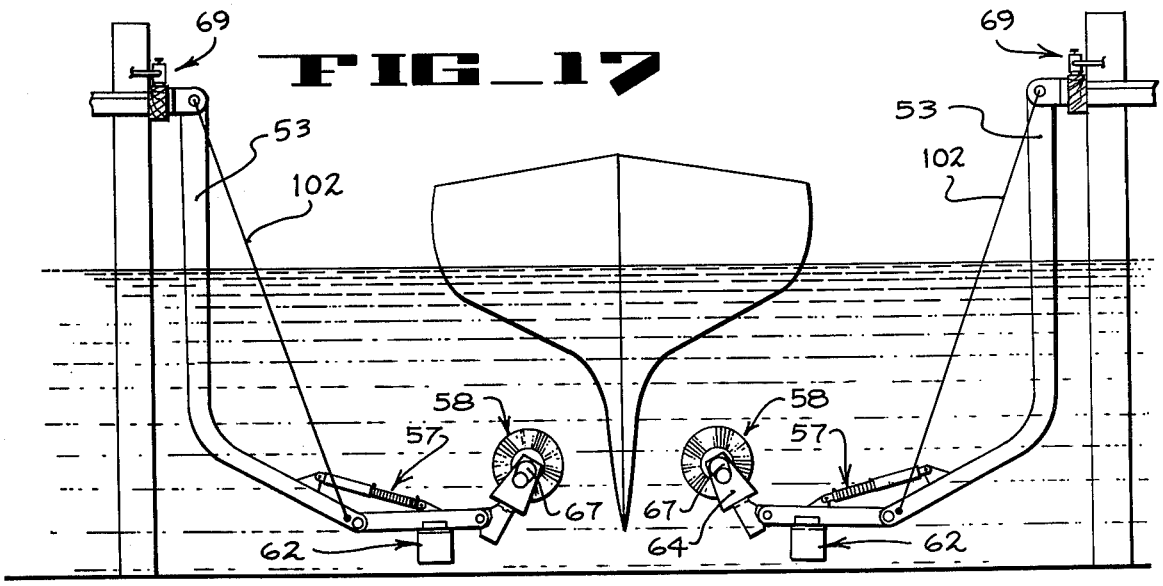
FIG. 17 shows a diagrammatic view of a berth in which groups of cleaning apparatus are disposed on both sides of the submerged portion of the hull be cleaned as the vessel advances through the berth.

As shown in FIG. 16 and in FIG. 17 diagrammatic representations of hull cleaning systems of a type in which the vessel is drawn, driven or otherwise propelled alongside a battery of cyclically rotating cleaning brushes of the kind described.

It has been observed that when a vessel encounters a group of such brushes it is advantageous for the brushes to be mounted in a manner to provide a certain amount of free movement in response to being contacted.

As shown in FIG. 16 stablizing cables 101, 102 have been attached to the submerged ends of members 53 indicated as 53' so that the entire unit can swing somewhat together in response to being scraped by a vessel passing thereagainst.

As further shown in FIG. 16 the flexibility of a system of the kind described is demonstrated in which the brushes can be oriented either to rotate along an axis which is transverse to the direction of motion of the vessel or about an axis which is substantially parallel to the direction of motion of the vessel as it passes therealong. In addition, by operating ram assembly 57' brush assembly 58' can be caused to move to an advanced position as shown in phantom lines at 58''. In this way each of the brushes can be disposed in the position found to be most advantageous in cleaning a particular portion of a given type of vessel.

What is claimed is:

1. Underwater cleaning apparatus for cleaning submerged portions of hulls comprising a cyclically movable cleaning means for cleaning hulls, a motor for cyclically operating said cleaning means, means for carrying said motor and cleaning means to dispose said cleaning means in cleaning relation to said hull, the last named means comprising first and second elongate members coupled in articulated relation, means supporting said cleaning means to be carried by the submerged end of said second member, means having variable buoyancy carried by one of said elongate members serving to lift and lower said cleaning means into and out of cleaning relation to the hull, and means for holding said first and second members at a given angle to each other, a pivot member carried by and pivoted to the upper end of said first member adapted to be secured to docking means, and means operable from said docking means for moving said cleaning means between raised and lowered positions in response to changes in buoyancy of said buoyant means.

2. Bottom cleaning apparatus for cleaning submerged portions of hulls of vessels comprising a cyclically movable cleaning means for operation in cleaning relation to the submerged hull portions, an elongate substantially rigid operation arm carrying said cleaning means therefrom at a submerged portion thereof, said arm extending upwardly to an operating position, means for pivotally coupling the upper end of said arm adjacent said operating position, a motor for cyclically operating said cleaning means submerged in cleaning relation to the hull, controls for operating said motor carried at a position remote from said cleaning means, connections extending between said motor and said controls, means having variable buoyancy carried by said operating arm at a position displaced therealong from said cleaning means to apply a buoyant force to said cleaning means serving to lift and lower said cleaning means into and out of cleaning relation with respect to said hull, and means operable from a position remote from said cleaning means for varying the buoyancy of the penultimate named means so as to vary the force applied between the cleaning means and the hull.

3. Bottom cleaning apparatus according to claim 2 wherein said cleaning means comprises a brush supported for rotation about an axis of rotation extending in a direction substantially parallel to the side of a vessel being cleaned.

4. Bottom cleaning apparatus for cleaning submerged portions of a hull comprising cyclically movable brush means for contacting the submerged portion of a hull to clean same, a motor for cyclically operating said brush means, an elongate substantially rigid member for carrying said motor and said brush submerged in cleaning relation to the hull, said elongate member serving to extend upwardly and sufficiently out of the water to be engaged manually by an operator holding the upper end of same while cleaning the hull, controls for operating said motor carried at a position remote from said brush and motor, connections between said motor and controls, means carried by said member at a position therealong displaced from said brush means and having variable buoyancy serving to lift and lower said brush into and out of engagement with said hull, and means operable from the upper end of said elongate member and remote from said cleaning means for varying the buoyancy of the variable buoyant means so as to change the force applied between the brush and the hull.

5. In a bottom cleaning system for cleaning underwater hull portions of a vessel comprising means forming a berth alongside which a vessel can approach for cleaning of those underwater hull portions confronting the first named means, a cleaning assembly including cleaning means, an elongate substantially rigid operating arm supporting said cleaning means from an end thereof and extending between said cleaning means and the first named said berth means, means having a controllable buoyancy carried by said operating arm at a position between said berth means and said cleaning means disposed along said member and serving to lift and lower said cleaning means into and out of cleaning relation with respect to said hull portions, and means operable from said berth for varying the buoyancy of said buoyant means to vary the force supplied between the cleaning means and said hull portions.

6. In a bottom cleaning system according to claim 5 comprising a plurality of said cleaning assemblies, and means for operating each said assembly independently of the others.

7. In a bottom cleaning system for cleaning underwater hull portions of a vessel comprising means forming a berth having spaced portions disposed and adapted to lie alongside each side of and to flank a vessel therebetween, a cleaning assembly carried from each said spaced portion, each cleaning assembly including cleaning means, an elongate means supporting said cleaning means and extending between said cleaning means and one of said portions, means having a controllable buoyancy carried by said elongate means serving to lift and lower said cleaning means in varying cleaning relation to the hull portions, and means operable from each of said berth portions for independently varying the buoyancy of each of said buoyant means to vary the cleaning relation between the cleaning means and hull portions.

* * * * *